US005567366A

United States Patent [19]

Motegi et al.

[11] Patent Number: 5,567,366

[45] Date of Patent: Oct. 22, 1996

[54] METHOD OF FINISHING A GREEN BODY

[75] Inventors: Kentaro Motegi; Yukio Ito; Yoshitaka Okamoto; Kuniyoshi Komura, all of Aichi, Japan

[73] Assignee: Inax Corporation, Tokoname, Japan

[21] Appl. No.: 267,482

[22] Filed: Jun. 29, 1994

[30] Foreign Application Priority Data

Jul. 9, 1993 [JP] Japan ..... 5-170344

[51] Int. Cl.[6] ..... B28B 7/04; B28B 11/00

[52] U.S. Cl. ..... 264/39; 264/40.1; 264/67

[58] Field of Search ..... 264/39, 40.1, 67

[56] References Cited

U.S. PATENT DOCUMENTS

| | | | |
|---|---|---|---|
| 1,709,733 | 4/1929 | Mitchell | 198/780 |
| 3,205,291 | 9/1965 | Derror | 264/336 |
| 3,285,433 | 11/1966 | Beneke et al. | 214/1 |
| 5,298,213 | 3/1994 | Shyu | 264/62 |

FOREIGN PATENT DOCUMENTS

| | | |
|---|---|---|
| 0059002 | 9/1982 | European Pat. Off. . |
| 2053886 | 2/1981 | United Kingdom . |

*Primary Examiner*—Christopher A. Fiorilla
*Attorney, Agent, or Firm*—Kanesaka & Tekeuchi

[57] ABSTRACT

A green body molded in a pressurized slip casting machine is loaded onto a pallet and sent to a conveyor. An image of the green body is picked up from above by a CCD camera, and whether the green body is a rectangular tank or a triangular tank is distinguished. When the green body is a rectangular tank holes are made in it by a first holemaking device, and when the green body is a triangular tank holes are made in it by a second holemaking device. After that, water removal, shape correction, deburring and the like are carried out automatically.

6 Claims, 13 Drawing Sheets

METHOD OF FINISHING A GREEN BODY

FIELD OF THE INVENTION

This invention relates to a method, employed in the manufacture of ceramic products such as sanitary earthenware, of finishing a green ware body (hereinafter referred to as a 'green body'), and particularly to a method of finishing a green body of a vessel or tank-like shape.

DESCRIPTION OF THE PRIOR ART

As an example of manufacture of a ceramic product, the manufacture of a low tank for supplying water to a lavatory will be described. Raw materials such as clay and pottery stone which include silica and sericite etc. are pulverized and made into a slip (a water slurry), and moldings (green bodies) of a predetermined shape are molded using molds such as gypsum molds and porous resin molds. After these green bodies have been dried they are made into products by glazing and firing.

Holes are made in the green bodies for mounting a metal fitting there around, the bodies are corrected in shape, and they are then sent to a drying process.

In slip casting such as pressurized slip casting, slip is injected under pressure into a casting cavity surrounded with a porous mold, and water channels provided in the mold are depressurized, so that water in the slip is absorbed by the mold. The water absorbed into the mold is discharged to outside the mold. After the body material adhered to the inner surface of the mold comes to a required thickness, the mold is opened. Before taking out the body, air pressure is applied to the water channels of the mold, so that water is effused to the inner surface of the mold to form a thin layer of water at the interface of the adhered material (the green body) and the mold.

Namely, after a lower part of the mold is released, a pallet is positioned just below an upper part of the mold. Then air pressure is applied to the upper mold to form a water layer on the inner surface thereof, so that the green body separates from the upper mold and drops onto the pallet.

When a vessel-shaped green body, such as a tank in the manner described-above molded is by pressure slip casting, a layer of water produced at the inner surface of the mold during mold opening is liable to stay in the green body. If this water remains there, cracks are formed in the molding during drying of the green body. To deal with this, conventionally a worker has wiped off the inside of the green body.

In pressurized slip casting, because the slip is pressure-injected into the mold, the slip enters between the mating surfaces of the molds to form burrs. Especially when a mold is worn, large burrs are formed easily. Conventionally, these burrs have been ground off by applying a grinding jig to them.

The green body thus goes through a number of processes from mold opening to drying, and conventionally these steps have mainly been carried out by hand and productivity has therefore been low.

OBJECT AND SUMMARY OF THE INVENTION

An object of the present invention is to provide a method of finishing a green body wherein a process between mold-opening and drying becomes simple.

According to the method of finishing a green body of the present invention, a green body with a vessel-like shape is finished by the following steps carried out under automatic control, including: a distinguishing step wherein the shape of the green body is distinguished by a distinguishing device; a holemaking step wherein a hole is made in the green body by a holemaking device applied to a predetermined location corresponding to the distinguished shape; a water removing step wherein a water-removing suction device is operated in conformity with a movement pattern corresponding to the distinguished shape and water is sucked out from the inside of the green body; a correcting step wherein a mold having a shape conforming to that required for the outer surface of the green body is selected in correspondence with the distinguished shape and applied to the outer surface of the green body, and a movable pressure plate is inserted into the green body for processing a side surface of the green body from the inner side against the mold to correct the shape of the side surface of the green body; a suction-holding step wherein with the mold in position on the outer surface of the green body a suction pad is pressed against an inner surface of the green body and the green body is suction-held; and an outer surface finishing step wherein the suction-held green body is lifted and brought into contact with an outer surface finishing device and finishing of the outer surface of the green body is carried out.

In this invention, the steps from the distinguishing step to the suction-holding step are preferably carried out with the green body on a pallet. The pallet from which the green body has been unloaded in the suction-holding step is washed, dried and stored, and the washed and dried pallets are supplied from a storage to the casting process.

In the distinguishing step of this invention, an image of the green body is picked up from above by for example a CCD (Charge Coupled Device ) camera, and the shape of the vessel-shaped body is distinguished (for example whether it is rectangular or triangular).

Next, in the water removing step, water is removed from the inside of the green body. In this step, by scanning a water removing tool over the bottom surface of the inside of the green body, water can be removed thoroughly.

In the holemaking step, holes are made in the green body at predetermined locations.

In the correcting step, the shape of the green body is corrected by compressing the green body between a mold on the outer surface side and the movable pressure plate on the inner surface side.

In the suction-holding step, suction pads are pressed against the inner surface of the green body and the green body is suction-held. At this time, because there are molds in position on the outer surface of the green body, pressing the suction pads against the inner surface of the green body does not cause the green body to lose its shape.

After that, the green body is lifted up and outer surface finishing step such as pressing the outer surface of the green body against a correcting mold and applying the edges of the green body to a rotating body to deburr them are carried out.

The green body is then sent to a drying step. In this invention, because this series of steps is carried out automatically under the control of a control device, each operation is extremely precisely made.

In the finishing method, the pallets are washed, dried and stored, and the washed and dried pallets are sent to the casting step, so that the green body does not get swollen by water on the pallet.

According to the green body finishing method of the invention, since all steps including water removal and shape correction are carried out automatically while the green bodies are transferred automatically, it is possible to manufacture the ceramics precisely in dimensions and reduce the time required for their manufacture.

Furthermore, according to this invention, the pallets can be automatically exchanged for clean, dry pallets.

PREFERRED EMBODIMENT

Figure 1:
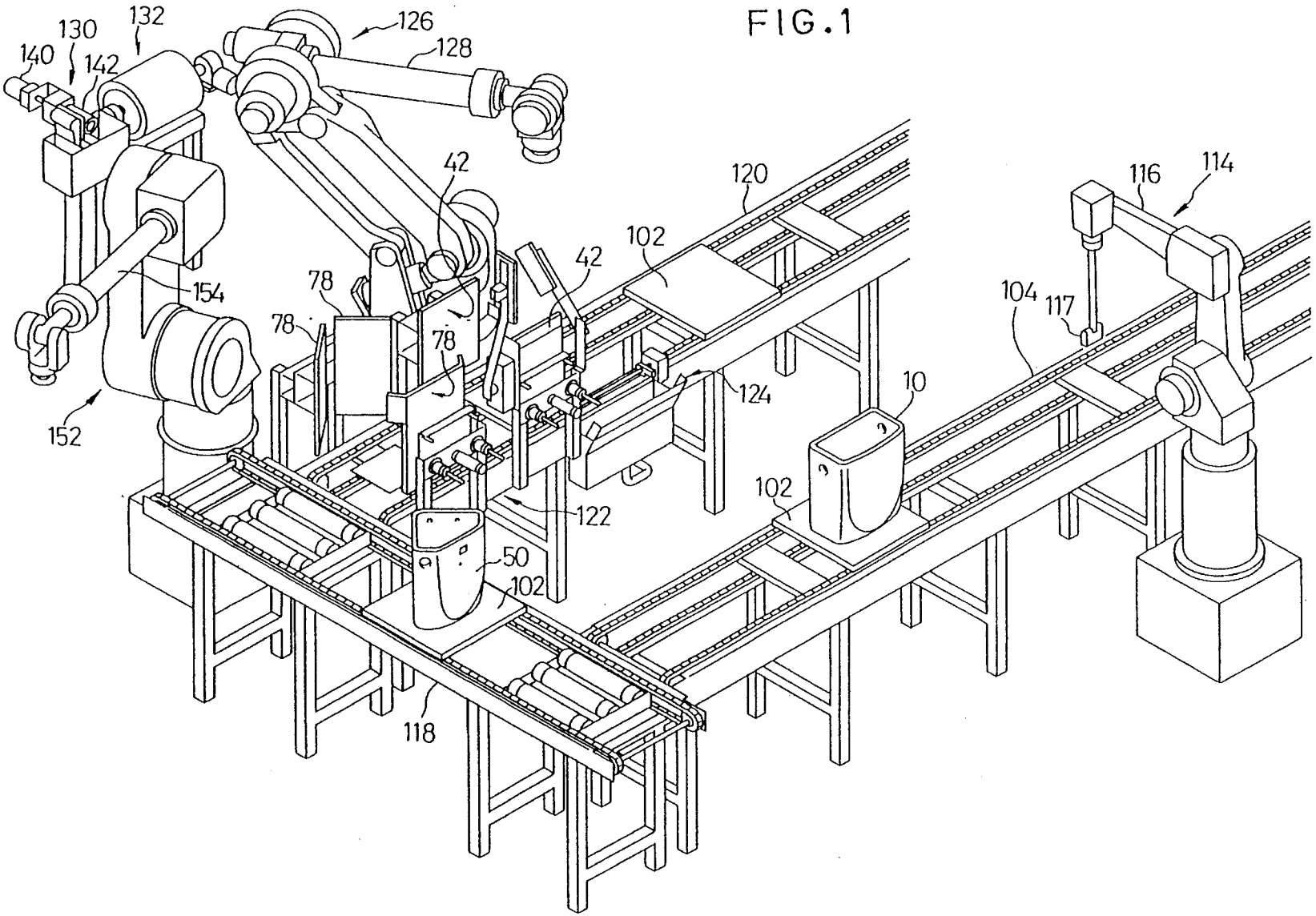
FIG. 1 is a perspective view illustrating a preferred embodiment of the method of the invention.
Figure 2:
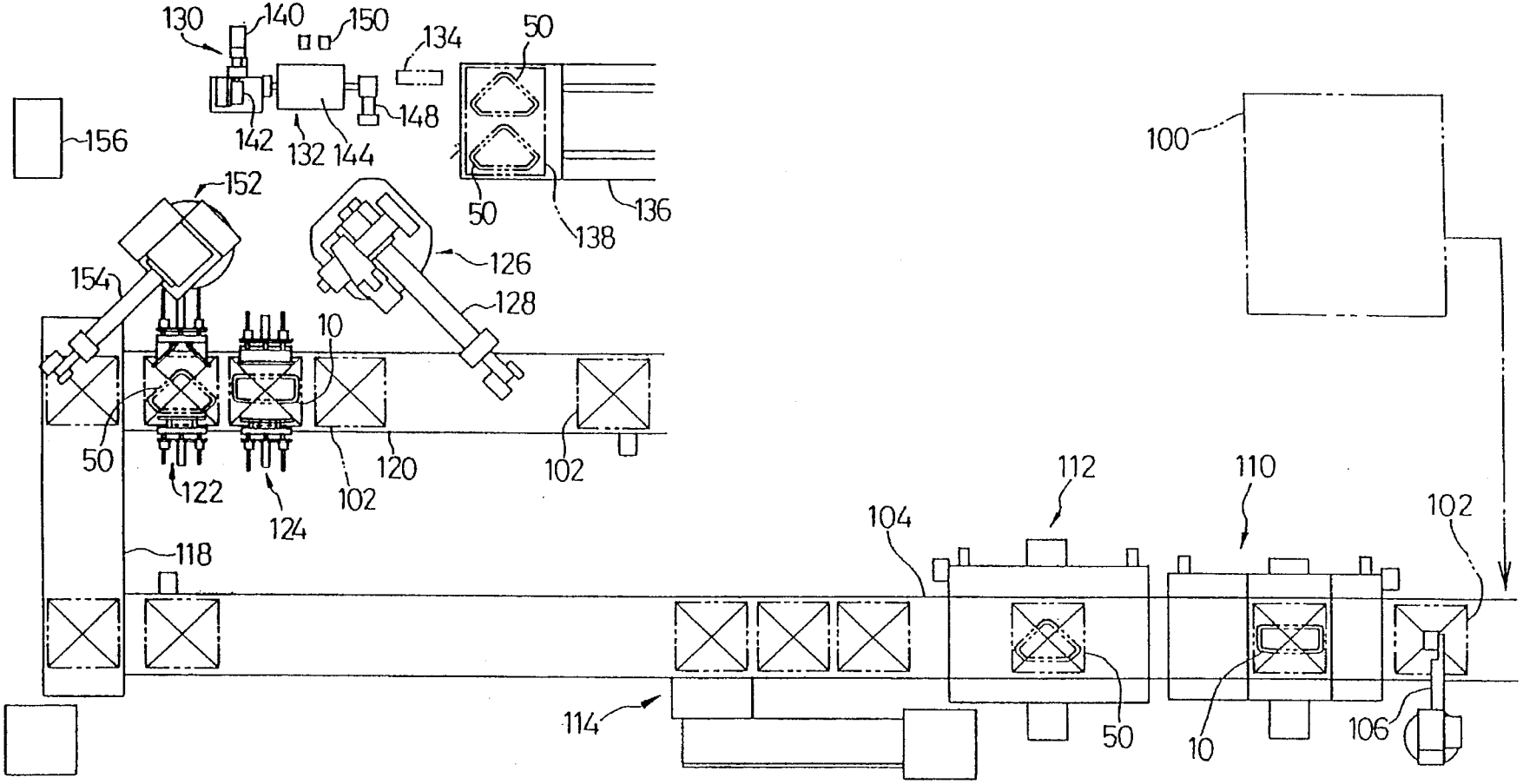
FIG. 2 is a plan view illustrating a preferred embodiment of the method of the invention.

A preferred embodiment of the invention will now be described, with reference to the accompanying drawings. FIG. 1 is a perspective view illustrating a preferred embodiment of the method of the invention, and FIG. 2 is a plan view illustrating the same embodiment.

Green bodies 10, 50 molded in a pressurized slip casting machine 100 (FIG. 2) are loaded onto pallets 102 and sent along a conveyor 104.

An image of the green body 10 is picked up from above by a CCD (Charge Coupled Device) camera 106, and whether the green body 10 is a rectangular tank or a triangular tank is distinguished. When it is a rectangular tank, holes are made in it by a first holemaking machine 110, and when it is a triangular tank holes are made in it by a second holemaking machine 112.

That is, a hole for mounting a water supply pipe, a hole for fitting a lever handle and a water discharge hole are made in prescribed locations on the tank.

Next, water is removed from the inside of the green body by a water removing robot 114. A water suction pipe (not shown in the drawings) and a water absorbing sponge 117 are mounted on the end of the arm 116 of this robot, and water is removed by suction and wiping off. During this process, the robot arm scans the entire bottom surface of the tank, according to the distinguished tank shape, and removes water from all parts of the tank bottom.

Next, the green bodies 10 and 50, still on the pallets 102, are sent to the correcting step by second and third conveyors 118 and 120.

In the case of a triangular tank, the green body 50 is stopped at a first stage 122 and molds 78, arranged in a triangle as seen in plan view, are pressed against the outer surface of the green body. In the case of a rectangular tank, the green body 10 is sent to a second stage 124 and stopped, and at this second stage 124, molds 42 are applied to the outer surface of the tank.

A tool for a triangular tank or a tool for a rectangular tank is attached to the end of the arm 128 of the shape correcting robot 126, as will be discussed in detail hereinafter, according to the shape of the green body. These tools can be fitted to and removed from the end of the arm 128 by means of a one-touch type joint, and tools can be exchanged according to the tank shape in an extremely short time.

An optical sensor (not shown in the drawings) for distinguishing the shape of the tank is mounted in the first stage 122, and selection of the stage at which the tank is to be stopped and the tool installed at the end of the robot arm is made according to the distinguishing result from this sensor.

With this tool, primary correction of the tank's shape is carried out in the first or second stage 122, 124. This shape correction is discussed in detail hereinafter with reference to FIGS. 3 to 16.

Next, the green body is suction-held and lifted by suction pads mounted on the tool, to be transferred to a deburring device, wherein the green body is deburred, and wiped off by a rotating sponge device 132. It is pressed against a mold member for shape correction (mounted in location 134 in FIG. 2) and secondary shape correction is performed, after which it is transferred onto a pallet 138 on a drying line conveyor 136.

This deburring device 130 comprises a rotating pipe (not shown in the drawings) rotated about its axis by a motor 140; a wire mesh 142 mounted in the form of a cylinder around the rotating pipe; and sponge spacers (not shown in the drawings), interposed between the rotating pipe and the wire mesh at each end of the rotating pipe, which create a predetermined gap between the rotating pipe and the wire mesh; the spacer at one end of the rotating pipe is adhered to either the wire mesh 142 or the rotating pipe, and the spacer at the other end is adhered to both the wire mesh 142 and the rotating pipe.

Burred edges of the green body are applied to this rotating wire mesh 142, and the wire mesh 142 cuts off the burrs. Because both ends of this wire mesh 142 are supported on the rotating pipe by sponges, the green body 10 is only pressed upon softly. Furthermore, because one end of the wire mesh 142 is not fixed to the rotating pipe, the wire mesh can expand and contract in the axial direction.

Thus the wire mesh 142 is prevented from pressing excessively hard on the green body and there is no danger such that the green body is deeply scratched. Also, because the wire mesh 142 is rotated, the burrs themselves are efficiently removed.

The surface of the green body is wiped off by the rotating sponge device 132 in order to remove silt (fine clay) contained in water that has run down along the green body surface and to remove clay residue adhered to the green body surface during deburring and holemaking, etc. If this silt remains adhered to the surface of the green body, glazing adhered to the surface in a later step might flake off during firing.

While the robot arm 128 is lifting and the green body 10 for deburring executing secondary shape correction on it and loading it onto the drying line conveyor, the arm 154 of another robot 152 lifts up the vacated pallet, rinses it with water in a tank (not shown in the drawings) and puts it into a storage box 156. A hot air fan blows hot air through the storage box 156, and the pallets are thereby dried in this storage box 156. When the robot arm 154 returns from the storage box 156, it grips a pallet in the storage box 156 that has already dried to load it onto a third conveyor 120. This dry pallet is conveyed by the conveyor 120 to the pressurized slip casting machine 100.

Next, the constructions of the tools used in the first and second stages will be described, with reference to Figs. 3 to 16.

Figure 3:
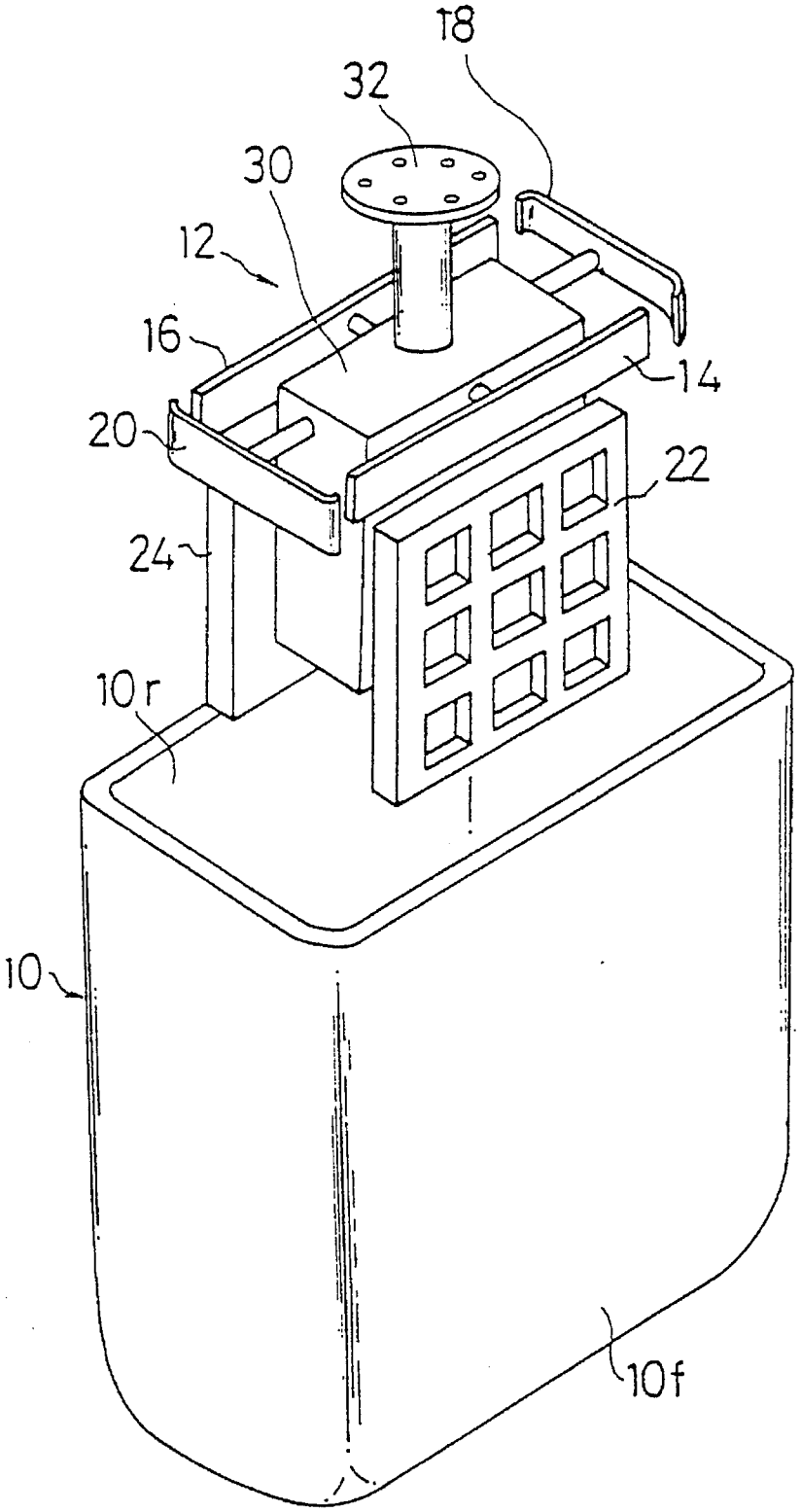
FIG. 3 is a perspective view of a green body transfer tool.
Figure 4:
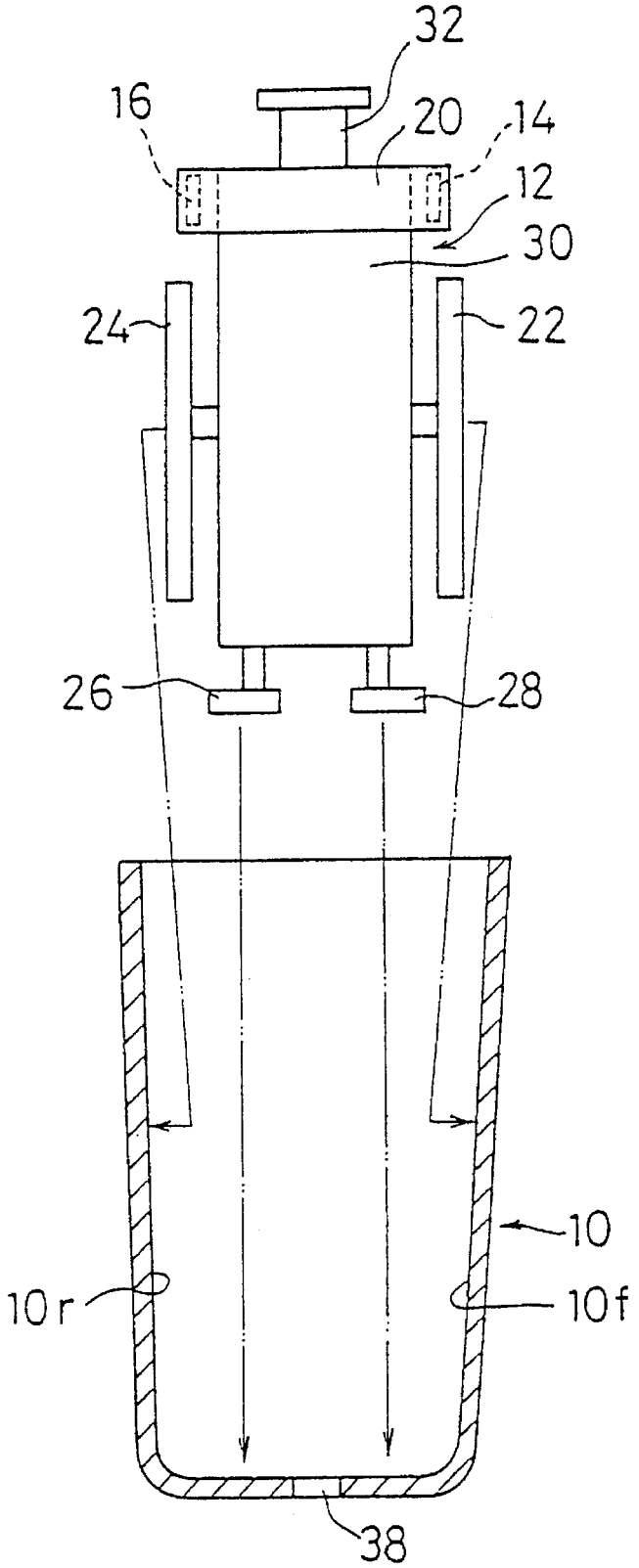
FIG. 4 is a side view of a green body transfer tool.
Figure 5:
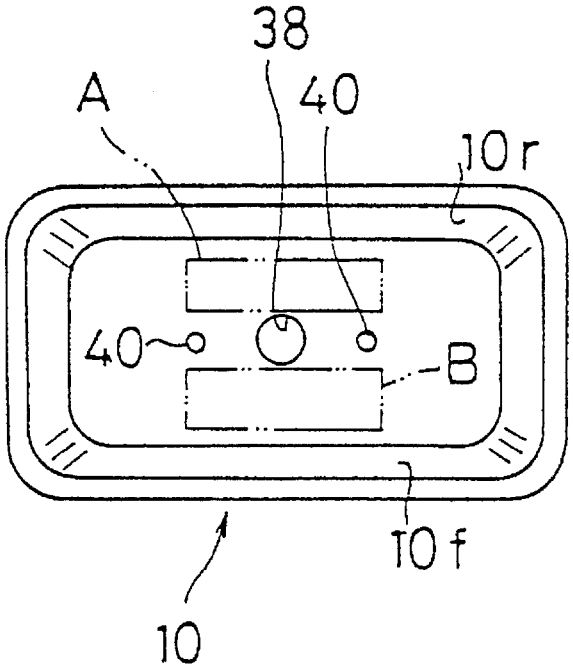
FIG. 5 is a plan view of a green body.
Figure 6:
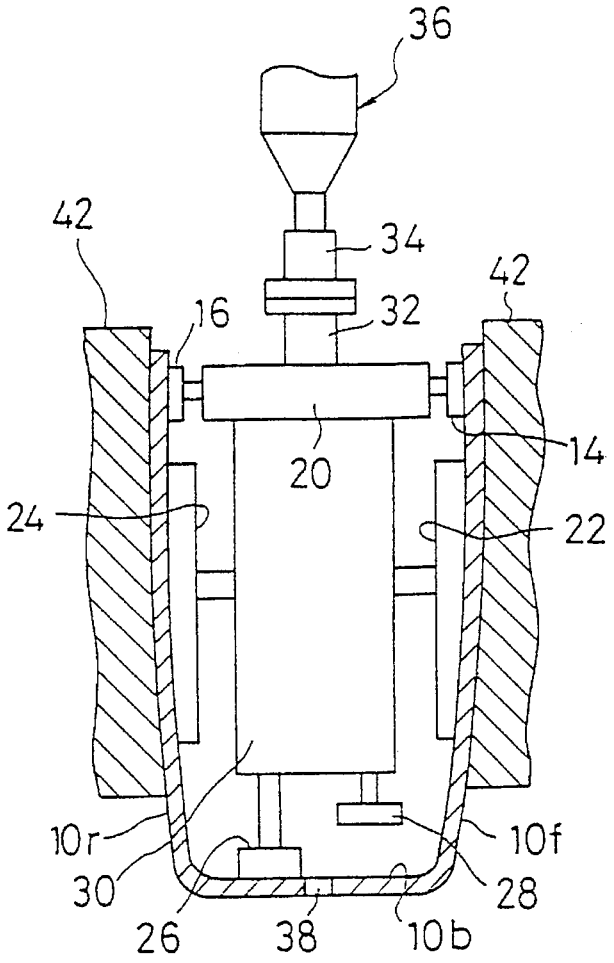
FIG. 6 is a vertical sectional view illustrating the operation of a green body transfer tool.
Figure 7:
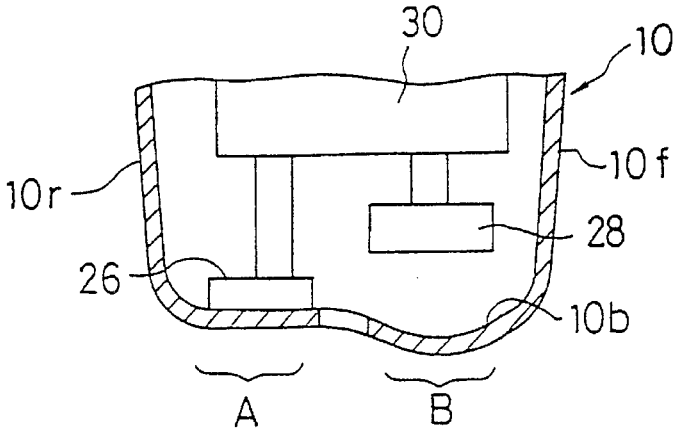
FIG. 7 is a sectional view of the lower part of a green body, illustrating the operation of a green body transfer tool.
Figure 8:
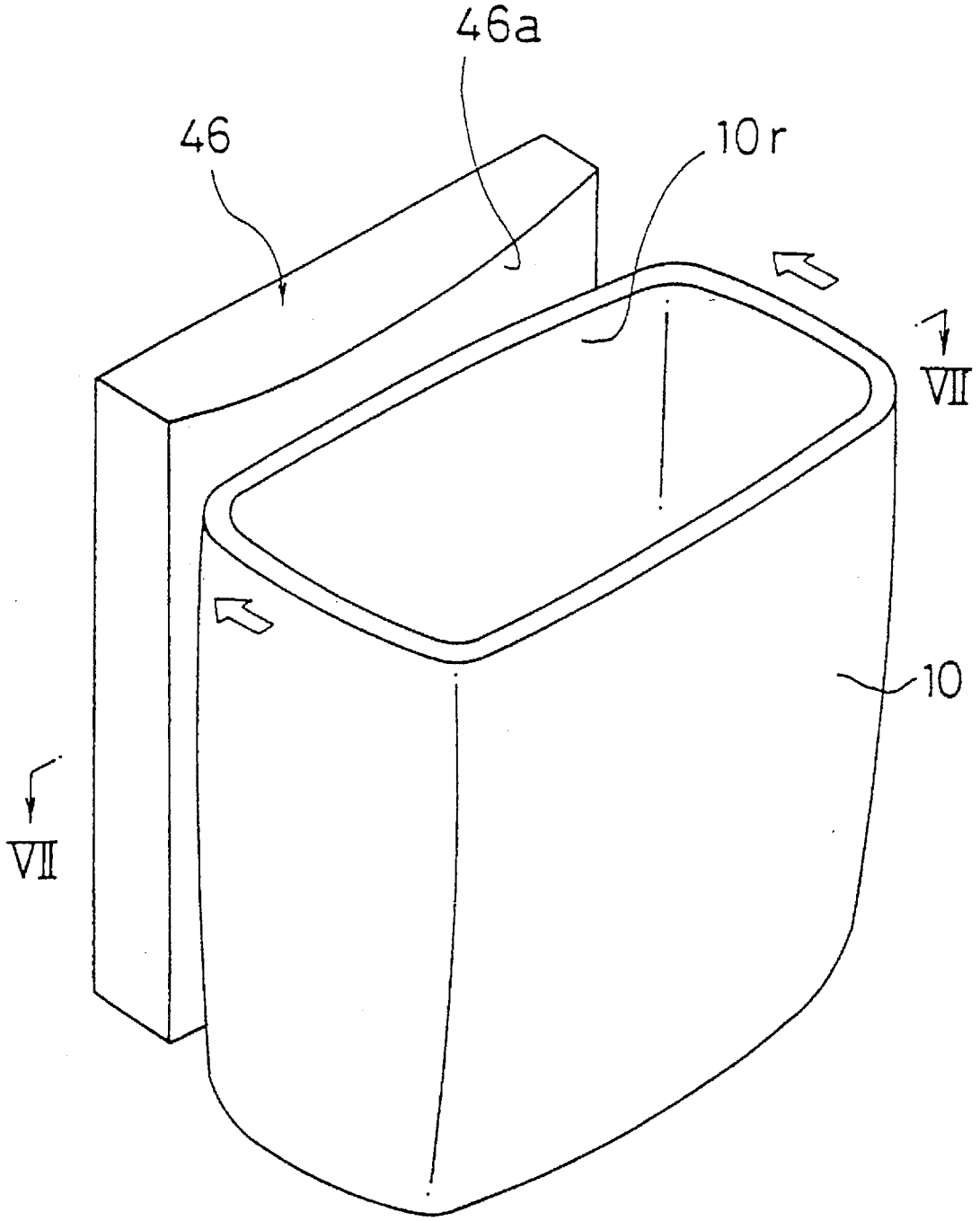
FIG. 8 is a perspective view illustrating a method for giving a green body a concave curvature.

FIG. 3 is a perspective view illustrating a tool for a green body as a rectangular low tank; FIG. 4 is a side view of the same tool; FIG. 5 is a plan view of a green body; FIG. 6 is a vertical sectional view illustrating shape correction and suction-clamping methods; FIG. 7 is a sectional view of the lower part of a green body, illustrating a shape correction method; and FIG. 8 is a perspective view illustrating a method for giving a green body a concave curvature.

A transfer tool 12 for transferring a rectangular green body 10 comprises four movable pushing plates 14, 16, 18 and 20, which are pressed against the inner surface of the upper part of the green body 10; suction pads 22, 24 which respectively suction-clamp the front surface 10*f* and the rear surface 10*r* of the green body 10; a bottom surface suction pad 26 and a movable pushing plate 28; and a mechanism box 30 containing mechanisms for advancing and retracting these movable pushing plates 14 to 20 and 28 and suction pads 22, 24 and 26 toward and away from the inner surface of the green body 10. A bracket 32 projects from the upper surface of the mechanism box 30 and, as shown in FIG. 6, the arm 36 of a transfer robot is connected to this bracket through a one-touch type joint 34. A negative pressure is transmitted to the mechanism box 30 from a depressurizing device (not shown in the drawings) through a pressure proof hose (not shown in the drawings), and the suction pads 22, 24 and 26 are suction-clamped onto the inner surface of the green body 10 by this negative pressure.

Compressed air is supplied to the mechanism box 30 from a compressor (not shown in the drawings), and the movable pushing plates 14 to 20 and 28 and the suction pads 22 to 26 are advanced and retracted toward and away from the inner surface of the green body by air cylinders (not shown in the drawings) actuated by this compressed air.

The transfer tool 12 is lowered from above into the green body 10 in the second stage by the robot arm 36. Also, correction molds 42 are brought into contact with the outer surface of the green body 10. Then, as shown in FIG. 6, the suction pads are brought into contact with the front surface 10*f*, the rear surface 10r and the bottom surface 10*b* of the green body 10, and the green body 10 is thereby held. The movable pushing plates 14, 16, 18 and 20 are pressed against the four side inner surfaces of the green body 10 and the shape of the upper edge of the green body 10 is corrected.

Because a lid is put on the top of a low tank, it is extremely important to correct the shape of the upper part of a low tank so that the dimensions of the lid and the dimensions of the upper part of the low tank match.

After shape correction of the upper part of this green body 10, the correction molds 42 are retracted and the movable pushing plates 14, 16, 18 and 20 are pulled away from the inner surface of the green body 10.

Then the robot arm 36 is actuated and the green body 10 is lifted up. The lifted green body 10, as described above, is first deburred by the deburring device 130. Then the outer surface of the green body is pressed against the rotating sponge device 132 and the outer surface is wiped off.

Figure 9:
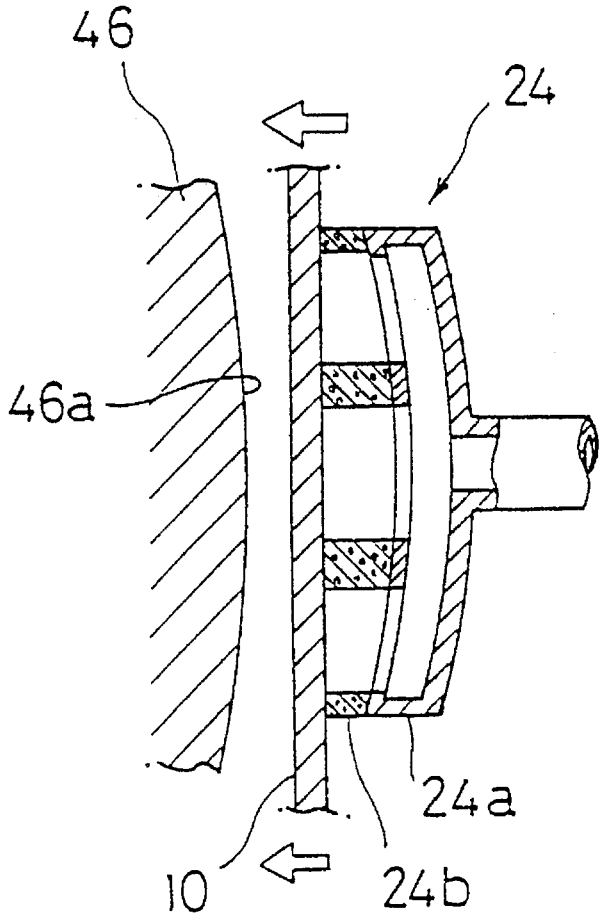
FIG. 9 is a sectional view, (taken along the line IX—IX in FIG. 8, illustrating a method for giving a green body a concave curvature.

The green body 10 then undergoes secondary shape correction by being pressed against the mold member. That is, as shown in FIGS. 8 and 9, the rear surface 10*r* is pressed against the convex surface 46*a* of the mold member 46 and the rear surface 10*r* is bent inward. This gives the rear surface 10*r* a concave curvature.

This green body is a wall-type low tank, and the rear surface 10*r* is given a concave curvature in order that the back of the low tank fit snugly against the wall surface. That is, if the center of the low tank projects, this projecting portion would hit the wall surface of the bathroom and as a result only a part of the back of the low tank would make contact with the wall surface. When the rear surface 10r of the low tank is concave, the entire periphery of the low tank rear surface 10*r* makes contact with the bathroom wall and the low tank can be fitted to the wall without any play between the two.

The bottom surface suction pad 26 suction-clamps an area. A of the bottom of the green body 10 at the rear of the water supply hole 38, as shown in FIGS. 5 to 7. Because the area B in front of the area A (FIG. 5) is not suction-held by any suction pad, while the green body 10 is being lifted and moved around, as shown schematically in FIG. 7 the area B often deforms plastically under its own weight and sags downward.

To remedy this, after the green body 10 is lowered onto the pallet (not shown in the drawing), the movable pushing plate 28 is pushed downward and presses the area B portion against the pallet. This makes the area B portion of the green body 10 flat again. After that, the movable pushing plate 28 and all the suction pads 22 to 26 are retracted away from the inner surface of the green body 10 and the transfer tool 12 is returned to its initial position and moves the next green body.

Figure 10:
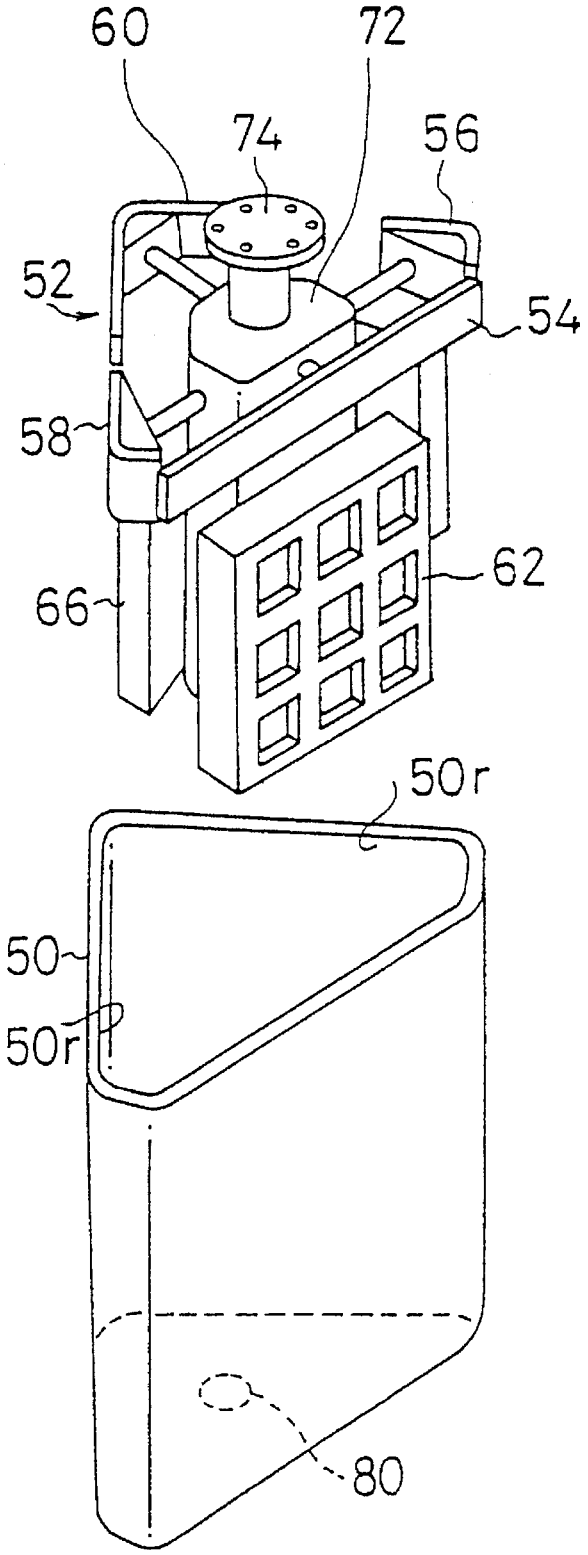
FIG. 10 is a perspective view illustrating another green body transferring tool as seen from the front-right.
Figure 11:
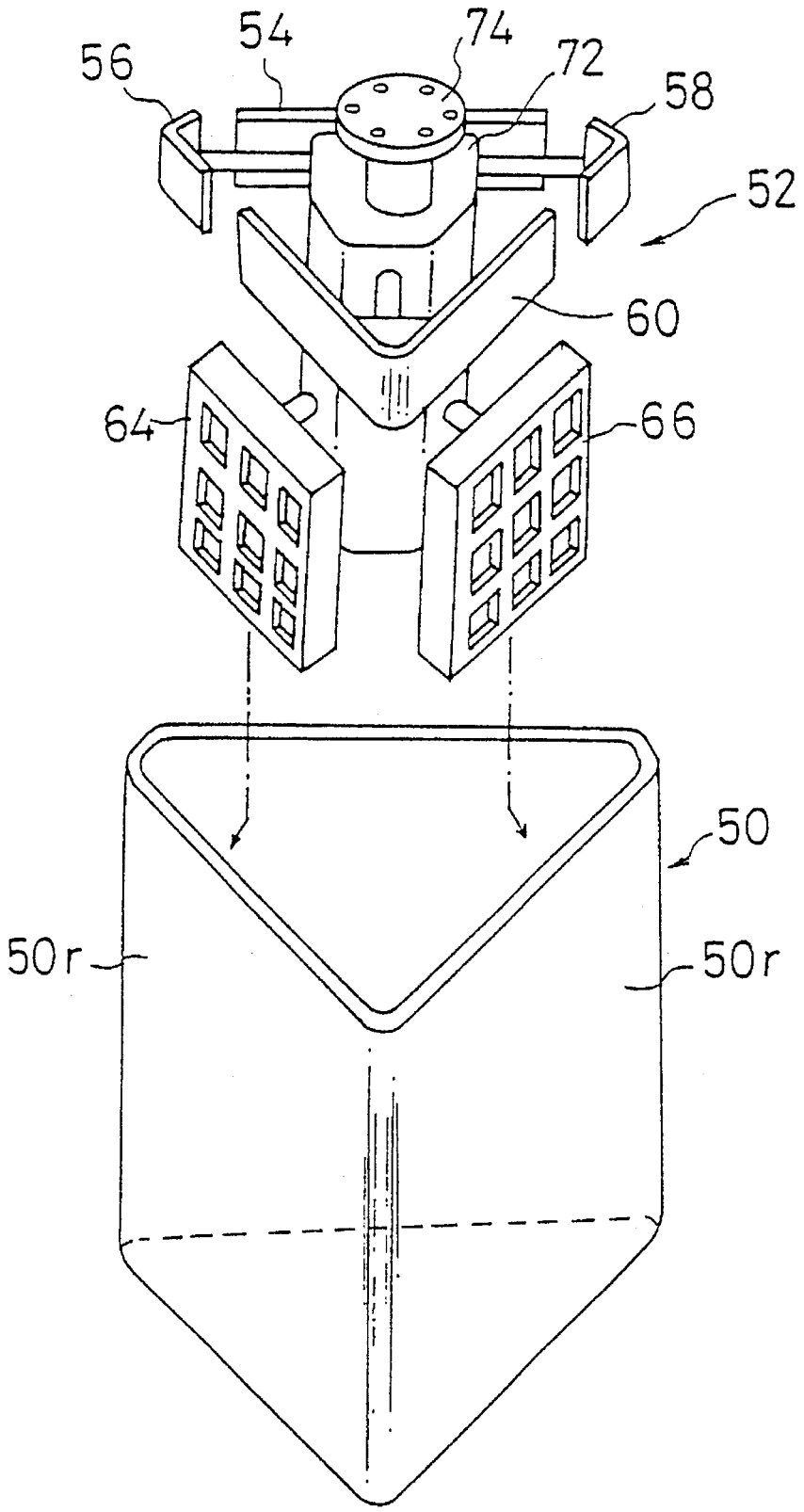
FIG. 11 is a perspective view illustrating the same tool as seen from the rear.
Figure 12:
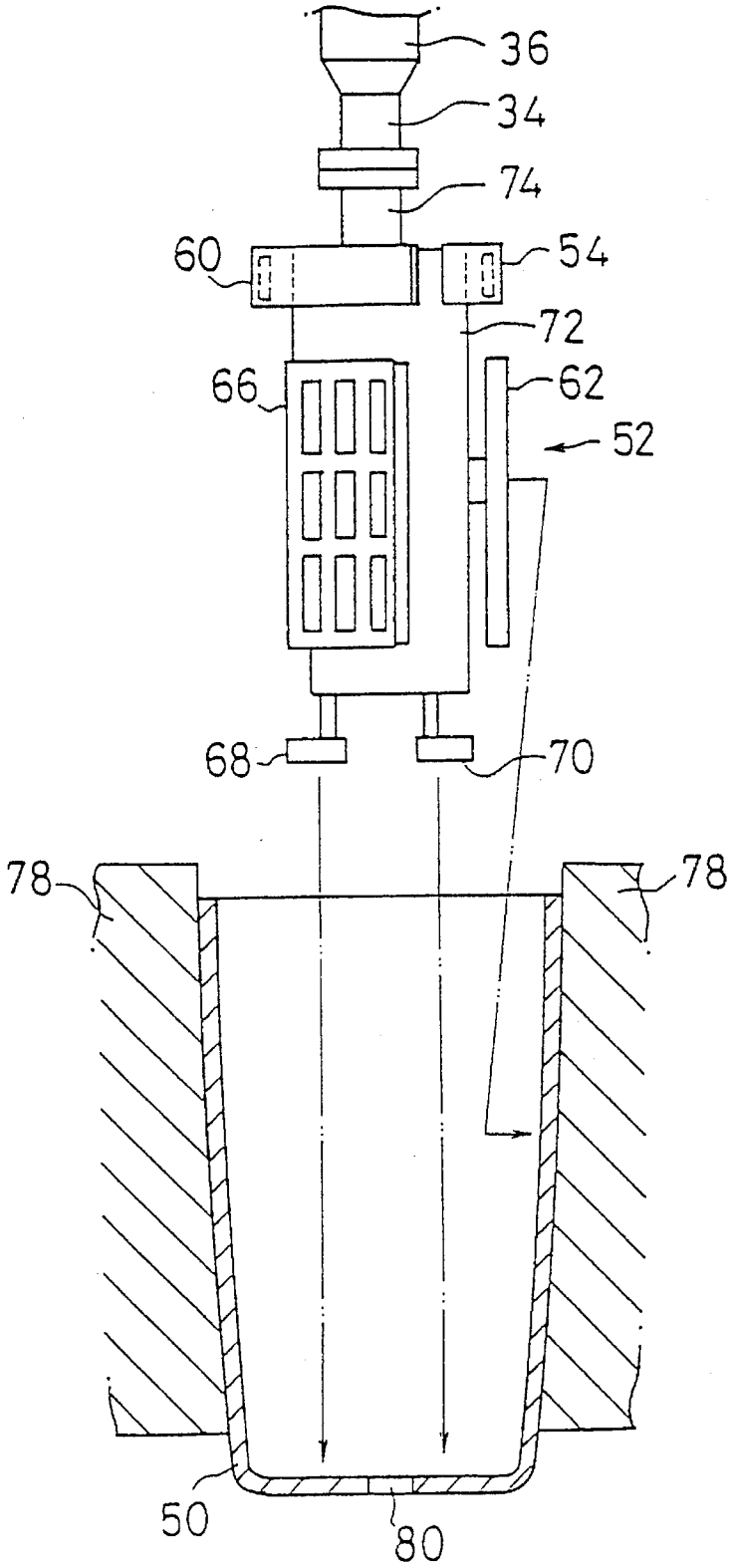
FIG. 12 is a vertical sectional view of the same tool.
Figure 13:
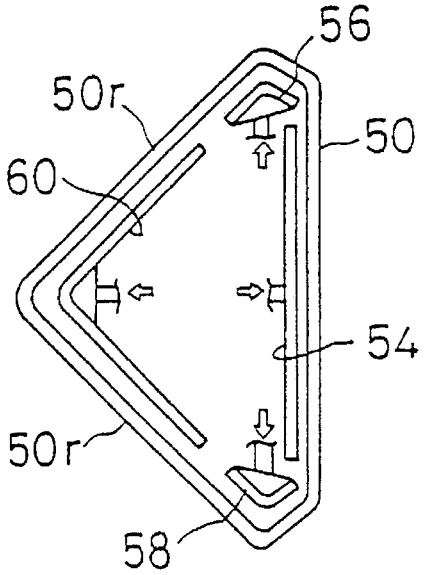
FIG. 13 is a plan view of a green body illustrating the operation of the same tool.
Figure 14:
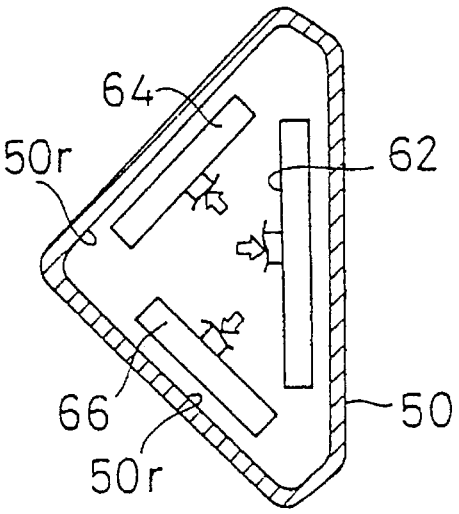
FIG. 14 is a horizontal sectional view of a green body illustrating the operation of the same tool.
Figure 15:
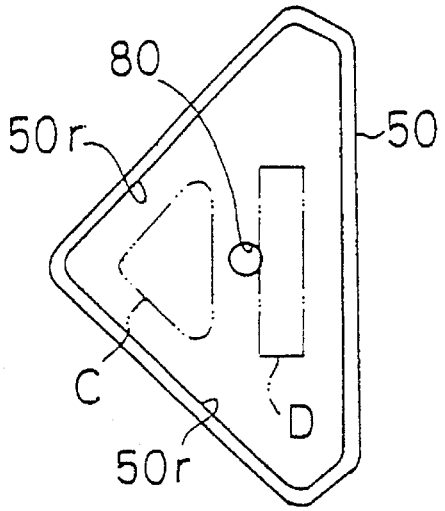
FIG. 15 is a plan view illustrating the operation of the same tool.

FIG. 10 is a perspective view from the front-right of a tool for shape correction and transfer of a green body of a triangular low tank, FIG. 11 is a perspective view of the same tool as seen from the rear, FIG. 12 is a vertical sectional view illustrating the operation of the same tool, and FIGS. 13 to 16 are plan views illustrating the operation of the same tool.

In this preferred embodiment, a green body 50 of a triangular prism-shaped corner-type low tank is transferred by a transfer tool 52.

This transfer tool 52 comprises movable pushing plates 54, 56, 58 and 60 which abut with the inner surface of the upper part of the green body 50; suction pads 62, 64 and 66 which are suction-clamped onto the inner surface of the sides of the green body; a bottom surface suction pad 68 (FIG. 12) which is suction-clamped to the bottom surface of the green body; a movable pushing plate 70 (FIG. 12) which is pressed against the bottom surface of the green body; a mechanism box 72 which carries these; and a bracket 74 which projects from the upper surface of the mechanism box 72.

The movable pushing plate 54 is pressed against the front surface of the upper part of the green body 50 and is rectangular. The movable pushing plates 56 and 58 are pressed against the left and right corner angle portions of the green body 50. The movable pushing plate 60 is L-shaped and is pressed against the rear corner angle portion and the left and right side portions 50*r*.

These movable pushing plates 54 to 60 and 70 and suction pads 62 to 68 are advanced and retracted by air cylinders (not shown in the drawings) mounted inside the mechanism box 72. A negative pressure is transmitted to the suction pads 62 to 68 from a hose (not shown in the drawings) connected to the mechanism box 72.

This transfer tool 52 is lowered into the green body 50 by a robot arm 36 to which it is attached via a one-touch joint 34 as shown in FIG. 12. Correction molds 78 (FIG. 12) are positioned around the outer surface of the green body 50 in advance.

The suction pads 62 to 68 are suction-clamped onto the inner surface of the green body 50 and the green body is thereby held. The movable pushing plates 54 to 60 are pressed against the green body 50, so that inner surface and shape correction of the green body 50 is performed. After that, the correction molds are moved away from the green body 50 and the green body is lifted and carried to a pallet for sending it to the drying step. The bottom surface suction pad 68 is suction-clamped to an area C (FIG. 15) at the rear of the water supply hole 80 in the bottom of the green body 50.

Figure 16:
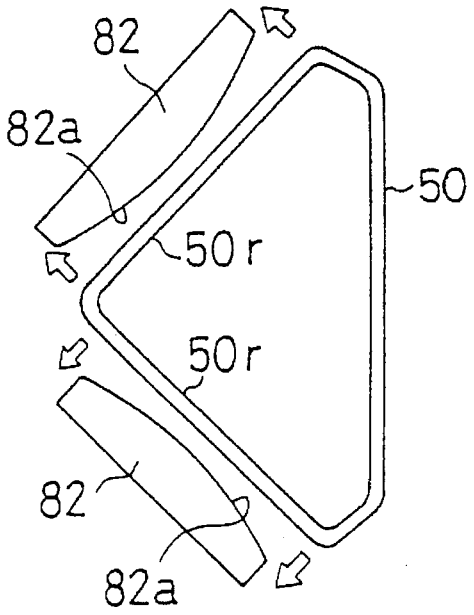
FIG. 16 is another plan view illustrating the operation of the same tool.

While the green body is being carried, as shown in FIG. 16, deburring by a deburring machine is performed. The left and right surfaces 50*r* of the green body 50 are then pressed against convex surfaces 82a of mold members 82 and the rear surfaces 50*r* are each given a concave curvature.

After that, the green body 50 is lowered onto a pallet and the movable pushing plate 70 is pressed against an area D (FIG. 15) at the front of the water supply hole 80 and this area D is made flat.

The suction pads 62 to 68 and the movable pushing plate 70 are retracted and the transfer tool is returned to its initial position.

The above preferred embodiment relates to the transfer of a green body of a low tank, but the invention can be applied to the finishing of various other kinds of green body.

What is claimed is:

1. A method of finishing a ceramic green body in which a ceramic green body with a vessel shape is finished by steps preceding a drying step, said steps being carried out under automatic control and comprising:

a distinguishing step wherein the shape of the green body is distinguished by a distinguishing device;

a holemaking step wherein a hole is made in the green body by a holemaking device in accordance with the distinguished shape;

a water removing step wherein a water-removing suction device is operated in conformity with a movement pattern corresponding to the distinguished shape and water is removed from an inside of the green body;

a correcting step wherein a mold having a shape conforming to that required of an outer surface of the green body is selected in correspondence with the distinguished shape and applied to the outer surface of the green body, and a movable pressure plate is inserted into the green body and presses a side surface of the green body from an inner side against the mold to correct a shape of the side surface of the green body;

a suction-holding step wherein with the mold in position on the outer surface of the green body, a suction pad is pressed against an inner surface of the green body and the green body is suction-held; and an outer surface finishing step wherein the suction-held green body is lifted and brought into contact with an outer surface finishing device and finishing of the outer surface of the green body is carried out.

2. A method of finishing a green body as set forth in claim 1, wherein:

the steps from the distinguishing step to the suction-holding step are carried out with the green body, having been molded in a casting step, loaded on a pallet;

a pallet from which the green body has been unloaded in the suction-holding step is washed, dried and stored; and a stored washed and dried pallet is supplied to the casting step.

3. A method of finishing a green body as set forth in claim 1, wherein:

an image of the green body is picked up from above by a charge coupled device camera and whether the green body is rectangular or triangular is distinguished.

4. A method of finishing a green body as set forth in claim 1, wherein:

water is removed from an inside of the green body by wiping by a water removing robot provided with a water absorbent sponge.

5. A method of finishing a green body as set forth in claim 1, wherein:

burrs are removed from the green body by a rotating cylindrical mesh brought into contact with the green body.

6. A method of finishing a green body as set forth in claim 1, wherein:

silt and clay residue are removed from the outer surface of the green body by a rotating sponge brought into contact with the outer surface of the green body.

* * * * *